US006396454B1

(12) United States Patent
Davis et al.

(10) Patent No.: US 6,396,454 B1
(45) Date of Patent: May 28, 2002

(54) RADIO UNIT FOR COMPUTER SYSTEMS

(75) Inventors: Steven J. Davis, Hermosa Beach; Gordon E. Kaiser, San Juan Capistrano, both of CA (US)

(73) Assignee: Cue Corporation, Irvine, CA (US)

( * ) Notice: Subject to any disclaimer, the term of this patent is extended or adjusted under 35 U.S.C. 154(b) by 0 days.

(21) Appl. No.: 09/602,234

(22) Filed: Jun. 23, 2000

(51) Int. Cl.[7] ..... H01Q 7/08

(52) U.S. Cl. ..... 343/788; 342/89; 342/465; 343/787

(58) Field of Search ..... 343/787, 788, 343/745; 336/182, 220, 221, 229; 342/74, 82, 89, 463, 465, 357.12, 385, 400, 444; H01Q 7/08

(56) References Cited

U.S. PATENT DOCUMENTS

| | | | | | |
|---|---|---|---|---|---|
| 2,488,325 | A | * | 11/1949 | Peek, Jr. | 175/21 |
| 3,750,180 | A | * | 7/1973 | Fujimoto et al. | 343/788 |
| 3,761,938 | A | * | 9/1973 | Reggia | 343/785 |
| 4,006,447 | A | | 2/1977 | Narbaits-Jaureguy et al. | 340/33 |
| 4,473,811 | A | * | 9/1984 | Schauble | 336/171 |
| 4,712,112 | A | * | 12/1987 | Carr | 343/788 |
| 4,812,843 | A | | 3/1989 | Champion, III et al. | 340/905 |
| 4,887,308 | A | | 12/1989 | Dutton | 455/156 |
| 4,940,921 | A | * | 7/1990 | Helling et al. | 315/219 |
| 5,065,138 | A | * | 11/1991 | Lian et al. | 340/572 |
| 5,131,020 | A | | 7/1992 | Liebesny et al. | 340/905 |
| 5,193,214 | A | | 3/1993 | Mardus et al. | 455/54.2 |
| 5,304,767 | A | * | 4/1994 | McGaffigan et al. | 219/674 |
| 5,572,201 | A | | 11/1996 | Graham et al. | 340/902 |
| 5,602,558 | A | * | 2/1997 | Urakami et al. | 343/850 |
| 5,654,717 | A | * | 8/1997 | Nichols et al. | 343/357 |
| 5,661,490 | A | * | 8/1997 | McEwan | 342/387 |
| 5,719,771 | A | | 2/1998 | Buck et al. | 340/988 |
| 5,774,827 | A | | 6/1998 | Smith, Jr. et al. | 701/209 |
| 5,808,566 | A | | 9/1998 | Behr et al. | 340/995 |
| 5,826,178 | A | * | 10/1998 | Owen | 455/193.1 |
| 5,835,026 | A | | 11/1998 | Wicks et al. | 340/905 |
| 5,848,373 | A | | 12/1998 | DeLorme et al. | 340/955 |
| 5,850,190 | A | | 12/1998 | Wicks et al. | 340/905 |
| 5,864,305 | A | | 1/1999 | Rosenquist | 340/905 |
| 5,884,216 | A | | 3/1999 | Shah et al. | 701/207 |
| 5,923,300 | A | * | 7/1999 | Mejia | 343/788 |
| 5,999,126 | A | * | 12/1999 | Ito | 342/357.1 |
| 5,999,138 | A | * | 12/1999 | Ponce de Leon | 343/745 |
| 6,014,111 | A | * | 1/2000 | Johannessen | 343/788 |
| 6,163,305 | A | * | 12/2000 | Murakami et al. | 343/788 |
| 6,211,822 | B1 | * | 4/2001 | Dougherty et al. | 342/357.12 |

* cited by examiner

*Primary Examiner*—Don Wong
*Assistant Examiner*—Trinh Vo Dinh
(74) *Attorney, Agent, or Firm*—Lyon & Lyon LLP

(57) ABSTRACT

A radio unit for computer systems for receiving and/or presenting data information transmitted within a commercial broadcast band and methods of manufacturing and using the same. The radio unit comprises an integrated antenna system, a first radio receiver, and an interface system for removably connecting the radio unit to a computer system. The integrated antenna system includes a first set of windings, a second set of windings, and a ferrite core with a first region and a second region. To reduce parasitic capacitance among the windings, the first set of windings are wound substantially in a first direction about a circumference of the first region, and the second set of windings are wound substantially in a second direction, substantially opposite said first direction, about a circumference of the second region and are coupled with the first set of windings at a junction between the first region and the second region. The first radio receiver is coupled with the integrated antenna system and receives transmitted data information. Substantially via the interface system, the first radio receiver communicates with the computer system, which is capable of presenting the transmitted data information.

8 Claims, 5 Drawing Sheets

RADIO UNIT FOR COMPUTER SYSTEMS

BACKGROUND OF THE INVENTION

A. Field of the Invention

The present invention relates generally to wireless messaging systems and, more particularly, to a wireless messaging system providing the capability to receive data information, including real-time weather and traffic alerts as well as personal messages, transmitted within a commercial broadcast band via a computer system.

B. Background of the Invention

1. FM Subcarrier Technology

FM subcarrier technology has been used in a number of applications, using a variety of analog and digital communication schemes. For example, Muzak, the familiar "elevator" music piped into physicians' offices, elevators and the like, uses a double side band AM modulation of a 67 KHz subcarrier to carry subscription music.

In another FM subcarrier application, known in Europe as the Radio Data System (RDS) and in the United States as the Radio Broadcast Data Service (RBDS), a 57 KHz subcarrier is modulated using bipolar phase shift keying to carry a low speed (1187.5 bps) digital data signal. This technique incorporates a unique block and bit synchronization method as well as a simple linear block encoding for error detection and correction. RDS is a very robust digital subcarrier communication scheme because of its long baud interval (~1 ms), low subcarrier frequency, and narrow bandwidth. This technology was originally invented and perfected by the Swedish Telecommunications Office and later extended in the rest of Europe. It has been adopted as an international standard and incorporates specification of the physical layer (the modulation and FM interface), the data link layer (error correction coding), and a network layer for service delivery. The channel modulation efficiency of RDS is about 0.3 bps/Hz.

Because of the low data rate of RDS, another format known as the Data Radio Channel (DARC) was invented by NHK in Japan to support a higher data rate FM subcarrier service. DARC is encapsulated into international standards (cf., EIA-794) as having four modes of operation at the physical level. The differences among these four modes involve the amount of error correction coding (ECC) overhead applied to the data transmission. At the physical layer, DARC is 16K bits per second minimum-shift keyed modulation of a 76K Hz subcarrier tone. DARC specifies all of the first four layers of the communications methodology: Physical, Data Link, Network, and the Transport layers.

Of the four modes of operation, the Frame B mode of DARC provides the best channel coding and error correction ability at the cost of reduced data payload rate. The net data rate, after application of layer 2 and layer 3 overhead, is 6,210 bits per second (bps). DARC offers a channel bit rate efficiency of about 0.66 bps/Hz, the typical value for a minimum-shift keyed modulation. This level of efficiency drops considerably after application of ECC.

Because of DARC's relatively high data rate, it has achieved use worldwide. Several IC manufacturers now deliver highly integrated decoders for receiver/demodulation design. Among the countries actively utilizing DARC systems are Sweden, Germany, Austria, France, Hungary, Japan, and the USA.

Offering comparable performance to DARC is the Subcarrier Traffic Information Channel (STIC) developed by the Mitre Corporation under finding from the Department of Transportation, Federal Highway Administration. This digital system uses a differentially encoded, quadrature phase-shift keyed modulation of either a 72.2K Hz of a 87.4K Hz subcarrier tone to deliver a 18,050 or 21,850 bps raw data rate. STIC also has a US standard (EIA-795) but is little known beyond the USA and has seen virtually no commercial use. Like the above systems, the STIC standard addresses layers 1 through 4 of the communications hierarchy. STIC is notable because it applies modern modem technology to a FM subcarrier system by using efficient convolutional coding, code concatenation and interleaving at the bit level to address channel impairments. The overall efficiency of STIC is on the order of 1.15 bps/Hz at the channel bit rate and a net of about 0.6 bps/Hz. Neither figure represents a very aggressive design. However, STIC was reported to be slightly superior to DARC in terms of overall performance in tests conducted in the USA by the Electronics Industry Association (EIA).

Several other "high-speed" subcarrier technologies have been developed over the past 10 years in the United States. Some of the more notable attempts are Seiko's 19K baud (8K bps nominal), SCA Data System's 32K bps proprietary system, Data Broadcasting Corporation's 19.2K bps FSK system, and Command Audio's proprietary DQPSK system, which is very similar to STIC in concept and structure. Command Audio has a portable subscriber unit, manufactured under license by Thompson Electronics, RCA Consumer Products Division, in commercial trials in Denver and Phoenix at the current time. Again, this system barely reaches a 2 bps/Hz efficiency. By contrast, telephone modem technology operates at 7 bps/Hz almost universally throughout the world, illustrating the difficulty of the propagation environment to which FM subcarrier systems are subjected and the rather low efficiency of the current FM subcarrier systems.

2. Computer Systems

Computer systems and, more particularly, portable laptop computers, palm-top computers, and personal digital assistants ("PDAs") continue to grow in popularity. As reliance upon such computer systems to accumulate and organize information as well as to facilitate communication continues to increase, users will keep trying to take fall advantage of the portability of their computer systems, expanding their use beyond the home and/or office.

Traditionally, a computer system required a modem or Ethernet adapter in combination with a hardwired communication link to receive information and/or to communicate with other computers. Today, wireless communications, such as communications in the cellular band, may be employed to transmit messages among remote computers without the restrictions on portability imposed by the hardwired communication link. As a result, users theoretically can utilize their computers to gather real-time information during the day simply by maintaining a connection to a communication network.

The use of existing wireless communication networks, however, suffers from a significant disadvantage: cost. Air time in the cellular band generally is very expensive. As a result, leaving one's computer connected to the existing wireless communication networks for extended periods of time generally would not economically feasible for the average user. The user instead must carefully balance the trade-off between the expense of cellular air-time and his need for updated, real-time information.

In view of the foregoing, it is believed that a need exists for wireless communications that overcome the aforementioned obstacles and deficiencies of currently available wireless communication systems.

SUMMARY OF THE INVENTION

The present invention is directed to a wireless messaging system providing the capability to receive transmitted data information, including incoming personal messages and/or real-time information regarding news, sports scores, weather conditions, and/or traffic conditions, transmitted within a commercial broadcast band. Through the use of the present invention, a user may be able to receive e-mails and/or real-time information virtually anywhere and at any time via his computer system. The present invention thereby provides the advantage of permitting remote reception of transmitted data information without incurring the expense associated with cellular transmissions.

A radio unit in accordance with the present invention may comprise an integrated antenna system, a first radio receiver, and an interface system for removably connecting the radio unit to a computer system. The integrated antenna system may include a ferrite core, a first set of windings, and a second set of windings. The ferrite core may have a circumference, a first region, and a second region, preferably opposite the first region. To reduce the capacitance between the windings, the first set of windings preferably are wound substantially in a first direction about the circumference of the first region; whereas, the second set of windings preferably are coupled with the ferrite core by being wound substantially in a second direction about the circumference of the second region. The first direction preferably is opposite the second direction. The first set of windings may be coupled with the second set of windings substantially at a junction between the first region and the second region.

The first radio receiver may be coupled with the integrated antenna system and preferably is capable, substantially via the integrated antenna system, of receiving transmitted data information. The first radio receiver also may be coupled with the interface system and preferably is capable of communicating with the interface system. Upon receiving transmitted data information, the first radio receiver may communicate the transmitted data information to a data memory system coupled with the first radio receiver and/or to the computer system. When the radio unit is connected to the computer system substantially via the interface system, the first radio receiver preferably communicates the transmitted data information to the computer system. The computer system then may retain the transmitted data information and/or may present, for example, visually substantially via a display, the transmitted data information either in its entirety or in part according to a preselected presentation criteria.

In a second preferred embodiment, the radio unit may include a second radio receiver for receiving transmitted audio information, such as music, new reports, and/or talk-radio from a commercial radio station, and an audio system. The second radio receiver may be coupled with the integrated antenna system, and the second radio receiver preferably is capable of receiving the transmitted audio information substantially via the integrated antenna system. The second radio receiver also may be coupled with, and capable of communicating with, the interface system. Further, the second radio receiver may be coupled with the audio system, which may selectively audibly present the transmitted audio information.

It will be appreciated that a radio unit in accordance with the present invention may permit a user to receive data information, such as personal messages and/or real-time information, that is transmitted within a commercial broadcast band, thereby avoiding incurring the expense associated with cellular communications. The radio unit may also allow the user to listen to, for example, his favorite radio station while receiving transmitted data information through the use of the second radio receiver. Further, since the transmission frequency of the radio station may differ from the transmission frequency of the transmitted data information, a user of a radio unit with a single radio receiver may be unable to receive the transmitted data information upon tuning the single radio receiver to receive the radio station, and vice versa.

DETAILED DESCRIPTION OF THE PREFERRED EMBODIMENTS

Figure 1:
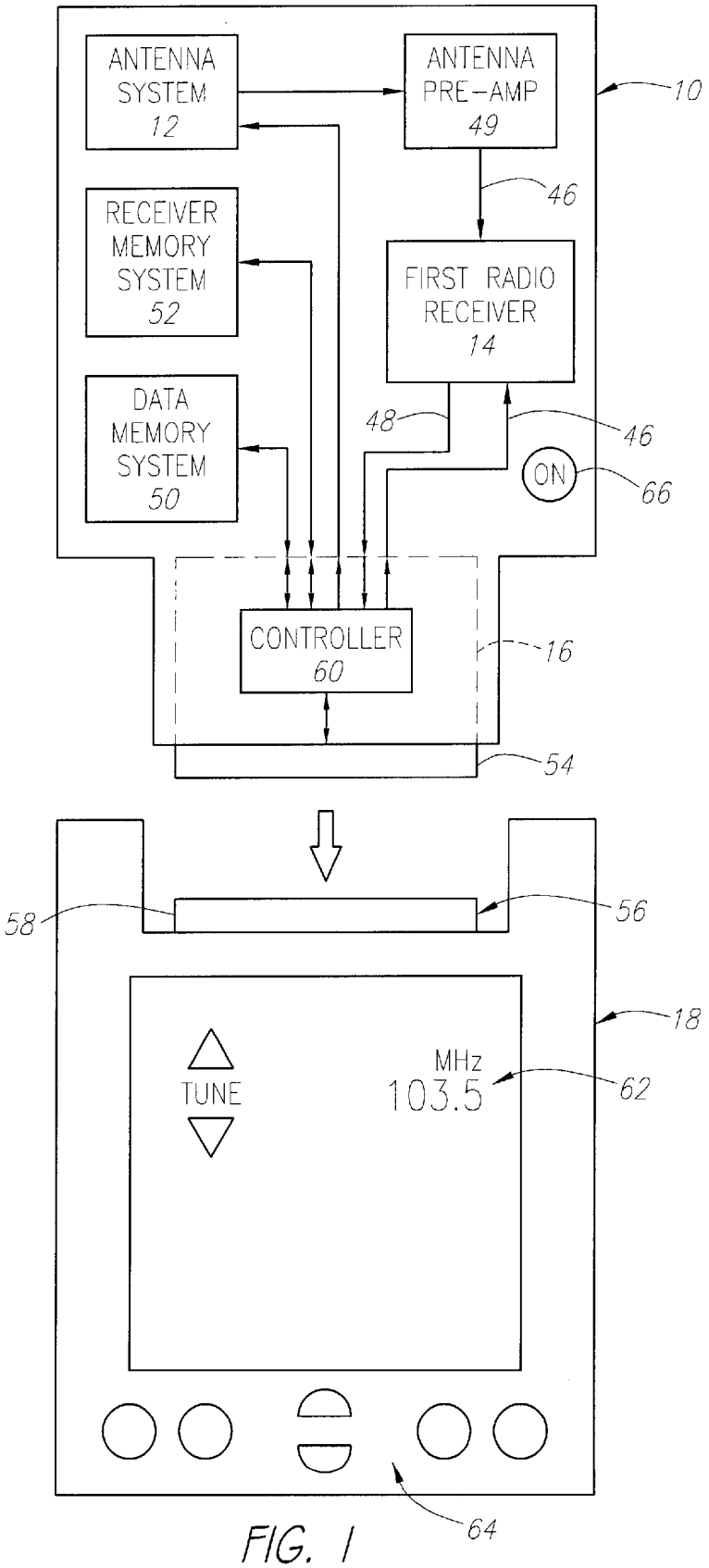
FIG. 1 is an illustration of one preferred embodiment of a radio unit for computer systems in accordance with the present invention.

Since service charges for sending and receiving transmissions within a cellular broadcast band can quickly become costly, transmitting and receiving data information via a commercial broadcast band may prove much more economical. This result may be achieved, according to one embodiment of the present invention, by employing a radio unit for computer systems 10 as shown in FIG. 1. The radio unit 10 may include an integrated antenna system 12, a first radio receiver 14, and an interface system 16 for removably connecting the radio unit 10 to a computer system 18.

Figure 2B:
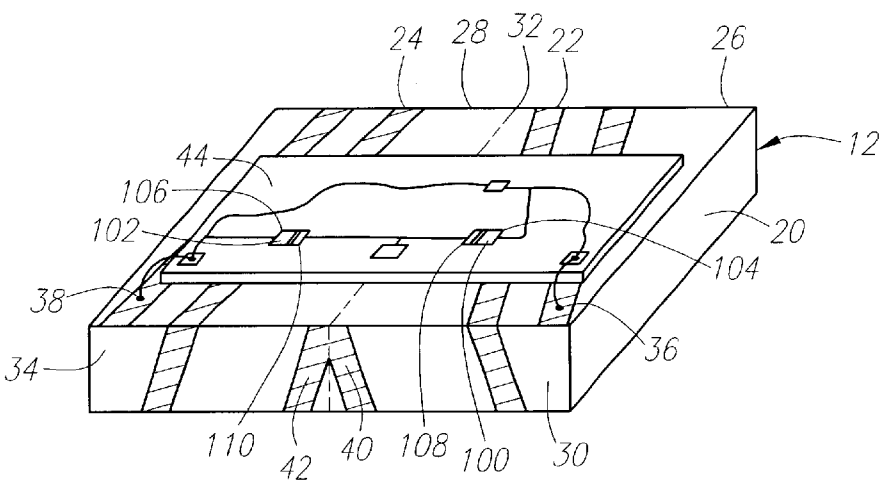
FIGS. 2A and 2B are detailed views of the integrated antenna system of FIG. 1.
Figure 2A:
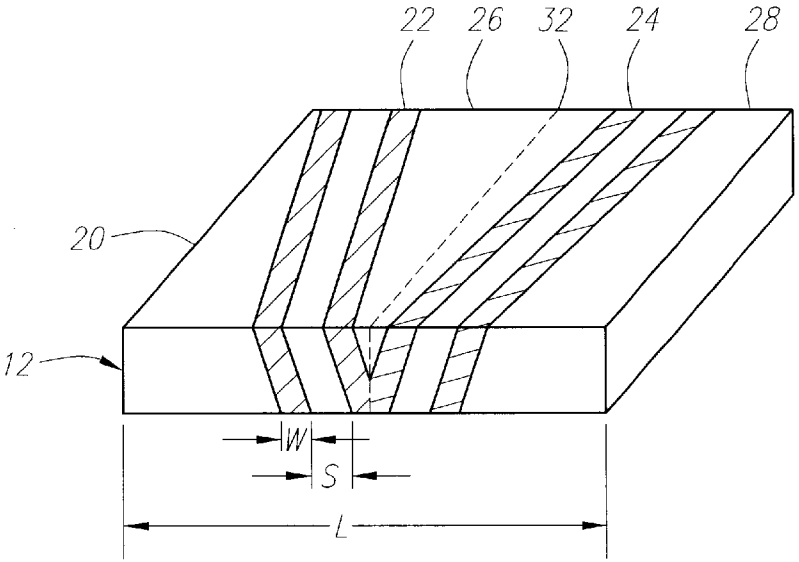

As shown in FIG. 2A and FIG. 2B, the integrated antenna system 12 may comprise a ferrite core 20, a first set of windings 22, and a second set of windings 24. The ferrite core 20 very preferably is formed from a material, such as a FE-1 material manufactured by Philips Components, with a relative permitivity of substantially ten at a frequency of one megacycles. The ferrite core 20 also may be comprised of one or more separately formed ferrite pieces and/or may be formed in any geometric shape, such a cylinder or a toroid, but preferably is formed substantially as a rectangular prism. The ferrite core 20 preferably has a length L and a circumference (not shown), which may be substantially uniform along the length L of the ferrite core 20. Very preferably, the length L of the ferrite core is 1.378 inches, and the ferrite core has a width and a thickness of 0.797 inches and 0.417 inches, respectively. The ferrite core 20 further may include a first region 26 and a second region 28. The first region 26 preferably is opposite the second region 28 and may be coupled with the second region 28 substantially via a junction 32. The first region 26 may include a first end portion 30; whereas, the second region 28 of the ferrite core 20 may include a second end portion 34. The first end portion 30 may be substantially opposite the second end portion 34. Very preferably, the junction 32 substantially bisects the ferrite core 20.

The first set of windings 22 and the second set of windings 24 each may be formed from any conductive material (not shown), such as gold, silver, copper, tin, steel, and/or any other conductive material. The conductive material may be formed into any shape; however, to reduce any signal loss associated with the conductive material, the conductive material preferably is formed into a shape that increases a surface area of the conductive material. Very preferably, the conductive material may be formed from a conductive tape, such as copper tape, and may have a width W of one-eighth inch.

To reduce the capacitance between the windings, the first set of windings 22 preferably are wound substantially in a first direction about the circumference of the first region 26 and thereby are coupled with the ferrite core 20; whereas, the second set of windings 24 preferably are coupled with the ferrite core 20 by being wound substantially in a second direction about the circumference of the second region 28. The first direction preferably is opposite the second direction. A spacing S between the windings may be substantially uniform. Very preferably, the spacing S between the windings is substantially equal to the width W of the conductive tape and/or the first set of windings 22 and the second set of windings 24 each substantially comprise two turns about the circumference of the first region 26 and the second region 28, respectively.

The first set of windings 22 and the second set of windings 24 each also may have a first end section 36, 38, and a second end section 40, 42. The first end section 36 of the first set of windings 22 preferably is coupled with the first region 26 at the first end portion 30. Likewise, the first end section 38 of the second set of windings 24 may be coupled with the second region 28 at the second end portion 34. The first end section 36 of the first set of windings 22 and the first end section 38 of the second set of windings 24 each further may be coupled with a pre-amplifier circuit 44. The second end section 40 of the first set of windings 22 may be coupled with the second end section 42 of the second set of windings 24 substantially at the junction 32.

Returning to FIG. 1, the first radio receiver 14 may have at least one input 46 and at least one output 48 and, very preferably, comprises a self-tuned radio, such as Philips Semiconductors Part No. TEA5757HL. One or more of the inputs 46 of the first radio receiver 14 may be coupled with the integrated antenna system 12, preferably via an antenna pre-amplifier 49, and the first radio receiver 14 preferably is capable of receiving transmitted data information (not shown) substantially via the integrated antenna system 12. The transmitted data information may include, for example, incoming personal messages and/or real-time information regarding news, sports scores, weather conditions, and/or traffic conditions. The transmitted data information may be broadcast within any commercial broadcast band within, for example, the AM, FM, and/or UHF frequency bands.

At least one of the inputs 46 and at least one of the outputs 48 of the first radio receiver 14 each may be coupled with the interface system 16 and preferably are capable of communicating with the interface system 16. The first radio receiver 14, for example, may provide the transmitted data information to the interface system 16, which may be capable of storing the transmitted data information in a data memory system 50. The data memory system 50 may be included within, and/or coupled with, at least one of the outputs 46 of the first radio receiver 14 and/or the interface system 16, and may comprise any form of electronic and/or magnetic storage medium, such as, for example, SRAM, DRAM, EEPROM, FLASH, a hard drive, or any other form of storage medium. The data memory system 50 preferably comprises non-volatile memory. The interface system 16 also may be capable providing and/or receiving one or more preselected data receiving parameters (not shown) to at least one of the inputs 46 and/or from at least one of the outputs 48, respectively, of the first radio receiver 14.

The first radio receiver 14 may be capable of operating in accordance with the preselected data receiving parameters. When received via the interface system 16, the preselected data receiving parameters may be retained in a receiver memory system 52 and may include, for example, one or more preselected center frequencies. The receiver memory system 52 may be included within, and/or coupled with, the first radio receiver 14 and/or the interface system 16, and may comprise any form of electronic and/or magnetic storage medium, such as, for example, SRAM, DRAM, EEPROM, FLASH, a hard drive, or any other form of storage medium. The receiver memory system 52 preferably comprises non-volatile memory. Very preferably, the preselected data receiving parameters are stored within the first radio receiver 14.

The interface system 16 may be capable of removably connecting the radio unit 10 to a computer system 18. The interface system 16 may comprise a first connector 54 for connecting the radio unit 10 to a data port 56 of the computer system 18, which, very preferably, includes a second connector 58. The second connector 58 of the data port 56 preferably mates with the first connector 54 of the radio unit 10. The first connector 54 preferably comprises a 68 pin PCMCIA connector, such as, for example, Method Electronics Part No. 952-07-68SM04-90-TR. The interface system 16 may further include a controller 60. The controller 60 preferably is coupled with the first radio receiver 14 and the interface system 16, and the first radio receiver 14 and the interface system 16 preferably communicate substantially via the controller 60. Any form of controller, such as a DSP, FPGA, PLD, PLA, PAL, and/or GAL, may be used. Very preferably, the controller 60 comprises a HCMOS microcontroller unit such as Motorola Part No. MC68HC908GP20 and is coupled with a non-volatile memory system (not shown), including any form of electronic and/or magnetic storage medium, such as, for example, EEPROM, FLASH, a hard drive, and/or any other form of non-volatile storage medium. The non-volatile memory system may contain default information and/or software or firmware for operating the controller 60 and/or the radio unit 10.

The computer system 18 may comprise any form of multipurpose, reconfigurable, and/or reprogrammable processing system, such as a personal computer, a laptop computer, a palntop computer, and/or a personal digital assistant ("PDA"). The computer system 18 preferably includes a portable computer system and, very preferably, substantially comprises a personal digital assistant, such as a Handspring Visor. Unlike the system set forth in the co-pending patent application, Ser. No. 09/455,614, filed on Dec. 7, 1999, the disclosure of which is incorporated herein by reference, the radio unit 10 of the present invention may employ any form of multipurpose, reconfigurable, and/or reprogrammable processing system for receiving and/or presenting transmitted data information.

Figure 3:
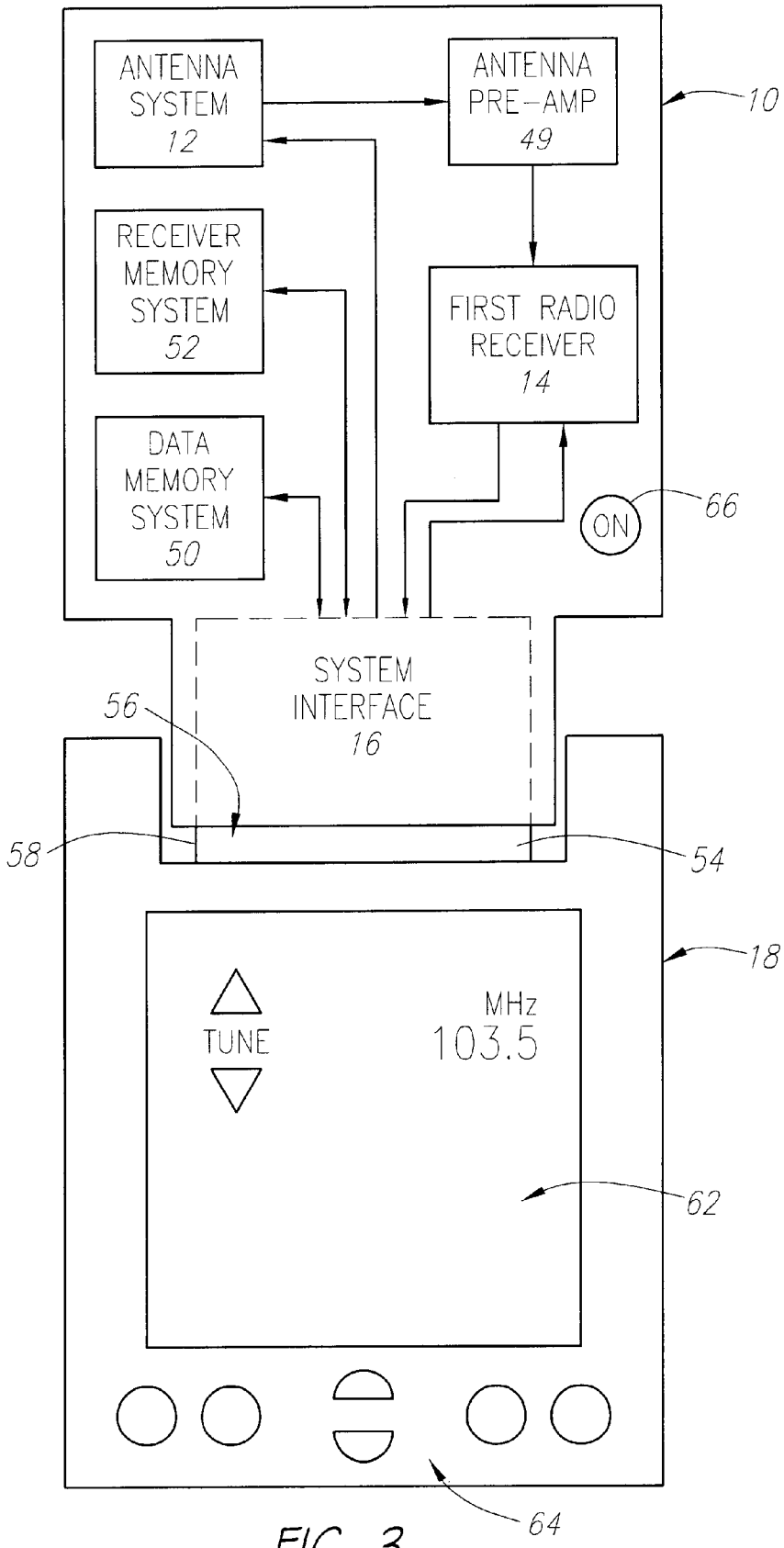
FIG. 3 is a detailed view of a first application of the radio unit of FIG. 1.

In operation, a radio unit 10 with a first radio receiver 14 may be removably connected to a computer system 18 substantially via an interface system 16 as shown in FIG. 3. The interface system 16 may include a first connector 54, and the interface system 16 may connect to a data port 56 of the computer system 18, which, very preferably, includes a second connector 40 for coupling the data port 56 with the first connector 54 of the interface system 16. When the interface system 16 of the radio unit 10 is coupled with the data port 56, the computer system 18 preferably identifies and/or configures the radio unit 10 for operation the computer system 18.

The first radio receiver 14 and the interface system 16 preferably communicate substantially via a controller 60. For example, when the computer system 18 is connected to the interface system 16, the controller 60 may substantially communicate the transmitted data information and other information, such as the revised data receiving parameters and/or other control information, between the first radio receiver 14 and the computer system 18. The controller 60 further may include processing capabilities for determining, for example, whether the computer system 18 is connected to the interface system 16 and whether to communicate the transmitted data information to the interface system 16 and/or the data memory system 50. Power conservation measures also may be controlled substantially via the controller 60. To perform the processing capabilities, the controller 60 may execute application code, such as software or firmware, which may be retained within a non-volatile memory system 49.

The first radio receiver 14 may function in accordance with one or more preselected data receiving parameters (not shown), such as a first predetermined data frequency. The first predetermined data frequency preferably comprises a center frequency at which the transmitted data information is being broadcasted. The preselected data receiving parameters may be retained by a receiver memory system 52. The receiver memory system 52 may be coupled with, and capable of communicating with, the first radio receiver 14 and/or the interface system 16. Very preferably, the receiver memory system 52 also includes a catalog of one or more preselected data receiving parameters, each of which may be selectively communicated to the first radio receiver 14. One of the preselected data receiving parameters may be selected automatically from the catalog based upon a preselected criteria, such as to correct a loss of reception, and/or manually, for example, via the computer system 18 and/or an input device (not shown) provided on the radio unit 10. Further, the computer system 18 and/or the input device on the radio unit 10 may be utilized to add and/or may delete one or more preselected data frequencies from the receiver memory system 52.

The first radio receiver 14 further may be coupled with an integrated antenna system 12. The integrated antenna system 12 preferably comprises at least one set of windings 22, 24 disposed around a ferrite core 20, as shown in FIG. 2B, each set of windings 22, 24 having an inductance (not shown). Very preferably, the integrated antenna system 12 comprises a first set of windings 22 and a second set of windings 24. A first end section 36 of the first set of windings 22 and a first end section 38 of the second set of windings 24 each may be coupled with one or more electronic components to resonate the ferrite core 20 at a preselected resonant frequency (not shown). For example, the first end section 36 and/or the first end section 38 may be coupled with a series variable capacitor, or a parallel variable capacitor may be disposed between the first end section 36 and the first end section 38. The resonant frequency of the ferrite core 20 may be adjusted by varying the capacitance coupled with the first end section 36 and/or the first end section 38.

Preferably, a series combination of a first varactor 100 and a second varactor 102, each having an anode 104, 106 and a cathode 108, 110, is disposed between the first end section 36 of the first set of windings 22 and the first end section 38 of the second set of windings 24. Very preferably, the first varactor 100 and the second varactor 102 each comprise a hyper-abrupt junction tuning diode such as Motorola Part No. MMBV105GLT1. The first end section 36 is coupled with the anode 104 of the first varactor 100, and the first end section 38 is coupled with the anode 106 of the second varactor 102. The cathode 108 of the first varactor 100 and the cathode 110 of the second varactor 102 each may be coupled with, and may be capable of communicating with, the interface system 16. Likewise, the first varactor 100 and the second varactor 102 may be configured in a common anode arrangement.

The resonant frequency of the ferrite core 20 may be controlled by communicating a ferrite tuning voltage (not shown) from a controller 60 and/or the computer system 18 via the interface system 16 to both the cathode 108 of the first varactor 100 and the cathode 110 of the second varactor 102. The controller 60 and/or the computer system 18 may generate the ferrite tuning voltage based upon, for example, a signal strength at the first predetermined data frequency. The signal strength may be communicated from the first radio receiver 14 to the controller 60 and/or the computer system 18 via the interface system 16. The controller 60 and/or the computer system 18 may receive the signal strength and, based upon a first preselected criteria (not shown), determine whether the resonant frequency of the ferrite core 20 should be adjusted. To adjust the resonant frequency, the controller 60 and/or the computer system 18 may generate an appropriate modified ferrite tuning voltage, communicating the modified ferrite tuning voltage to the cathode 108 and the cathode 110. Alternatively, a quality of the transmitted data information may be compared against a second preselected criteria by the controller 60 and/or the computer system 18, which may, in turn, generate an appropriate modified ferrite tuning voltage for the ferrite core 20.

During and/or after identification and/or configuration, the first radio receiver 14 may communicate one or more of the preselected data receiving parameters to the computer system 18 substantially via the interface system 16. One or more of the preselected data receiving parameters then may be presented by the computer system 18; for example, the preselected data receiving parameters may be visually presented on a display 62 coupled with the computer system 18. Through use of an input device 64, such as a keyboard, mouse, buttons, and/or a stylus, coupled with the computer system 18, one or more of the preselected data receiving parameters may be adjusted to comprise revised data receiving parameters, such as a second predetermined data frequency. The computer system 18 preferably communicates the revised data receiving parameters to the first radio receiver 14, substantially via the interface system 16. The first radio receiver 14 then may respectively implement, and/or retain within the receiver memory system 52, the revised data receiving parameters.

In accordance with the preselected data receiving parameters and/or the revised data receiving parameters, the first radio receiver 14 preferably receives transmitted data information (not shown) substantially via the integrated antenna system 12 and may communicate the transmitted data information to a data memory system 50 within the radio unit 10 and/or to the computer system 18 substantially via the interface system 16. When the radio unit 10 is connected to the computer system 18 via the interface system 16, the first radio receiver 14 preferably communicates the transmitted data information to the computer system 18. Upon receipt, the computer system 18 may retain the transmitted data information and/or may present, for example, visually substantially via the display 62, the transmitted data information either in its entirety or in part according to a preselected presentation criteria. In a similar manner, the radio unit 10 further may be capable of broadcasting data information, such as a reply to a previously received email message, generated by the computer system 18 within a commercial broadcast band.

The radio unit 10 may be powered by the computer system 18 and/or may include an auxiliary power source (not shown), such as batteries, a vehicle cigarette lighter adapter, and/or an A/C power adapter, that may be independent from the computer system 18. The auxiliary power source preferably includes voltage regulation. To conserve power, the components of the radio unit 10, such as, for example, the first radio receiver 14, each preferably are capable of being individually and/or automatically powered down. Each component may be automatically powered down when a preselected criteria, such as non-use for a predetermined period of time, has been satisfied. The radio unit 10 also may include a capability for manually powering down each component, for example, substantially via a switch 66 provided on the radio unit 10 and/or a power down command communicated from the computer system 18 to the radio unit 10.

Upon removal from the computer system 18, the components of the radio unit 10 may automatically power down or may remain powered by, for example, the auxiliary power source. The first radio receiver 14, if powered, preferably receives transmitted data information in accordance with the preselected data receiving parameters and/or the revised data receiving parameters retained in the receiver memory system 52. The transmitted data information may be communicated to the data memory system 50. Very preferably, the transmitted data information is retained as stored data information within the data memory system 50 at least until the connection between the radio unit 10 and the computer system 18 has been reestablished, and the stored data information has been communicated from data memory system 50 to the computer system 18.

Figure 4:
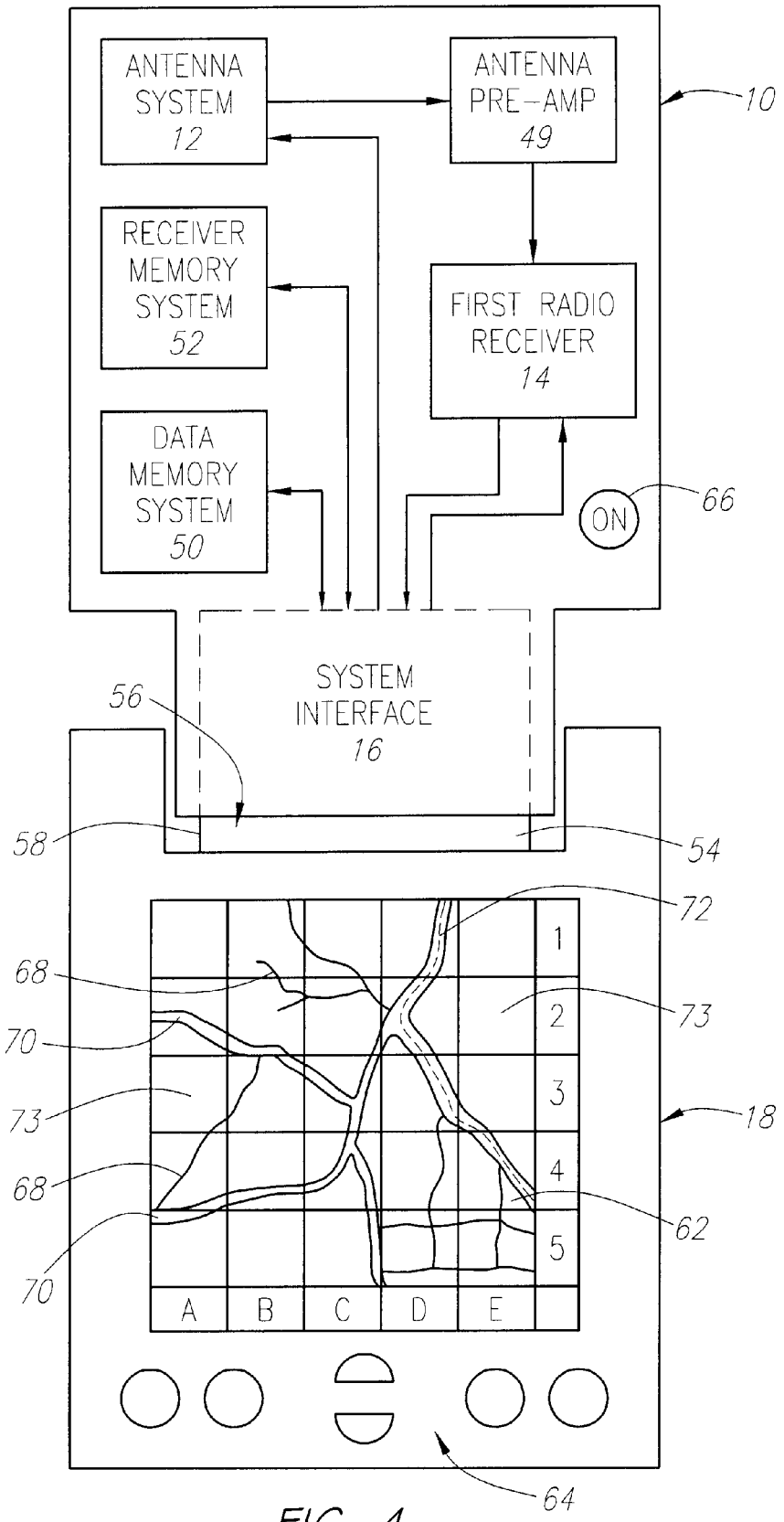
FIG. 4 is a detailed view of a second application of the radio unit of FIG. 1.

One application the radio unit 10 may include providing route-specific real-time information, such as traffic and/or weather information, to commuters. An example of such a system is set forth in a co-pending patent application, Ser. No. 09/455,614. As shown in FIG. 4, using special application software, one or more maps of a geographical region may be visually presented on the display 62 of the computer system 18. Each map may comprise, for example, one or more surface streets 68 and/or freeways 70 traversing the displayed geographical region. The map may be divided into a plurality of zones 73 as shown in FIG. 3, and the commuter preferably enters one or more preselected commuter routes 72 by selecting one or more of the zones 73 via the input device 64 coupled with the computer system 18. Very preferably, the commuter also selects a preselected data frequency, which is communicated to the first radio receiver 14.

After the preselected commuter routes 72 have been entered, the first radio receiver 14 may receive real-time information. The radio unit 10 may communicate the real-time information to the data memory system 50 and/or to the computer system 18. If connected to the radio unit 10, the computer system 18 may receive the real-time information, preferably determining which, if any, of the real-time information may be relevant by comparing the real-time information to the preselected commuter routes 72. Any real-time information relevant to the preselected commuter routes 72 then may be presented via the computer system 18, preferably visually on the display 62.

Figure 5:
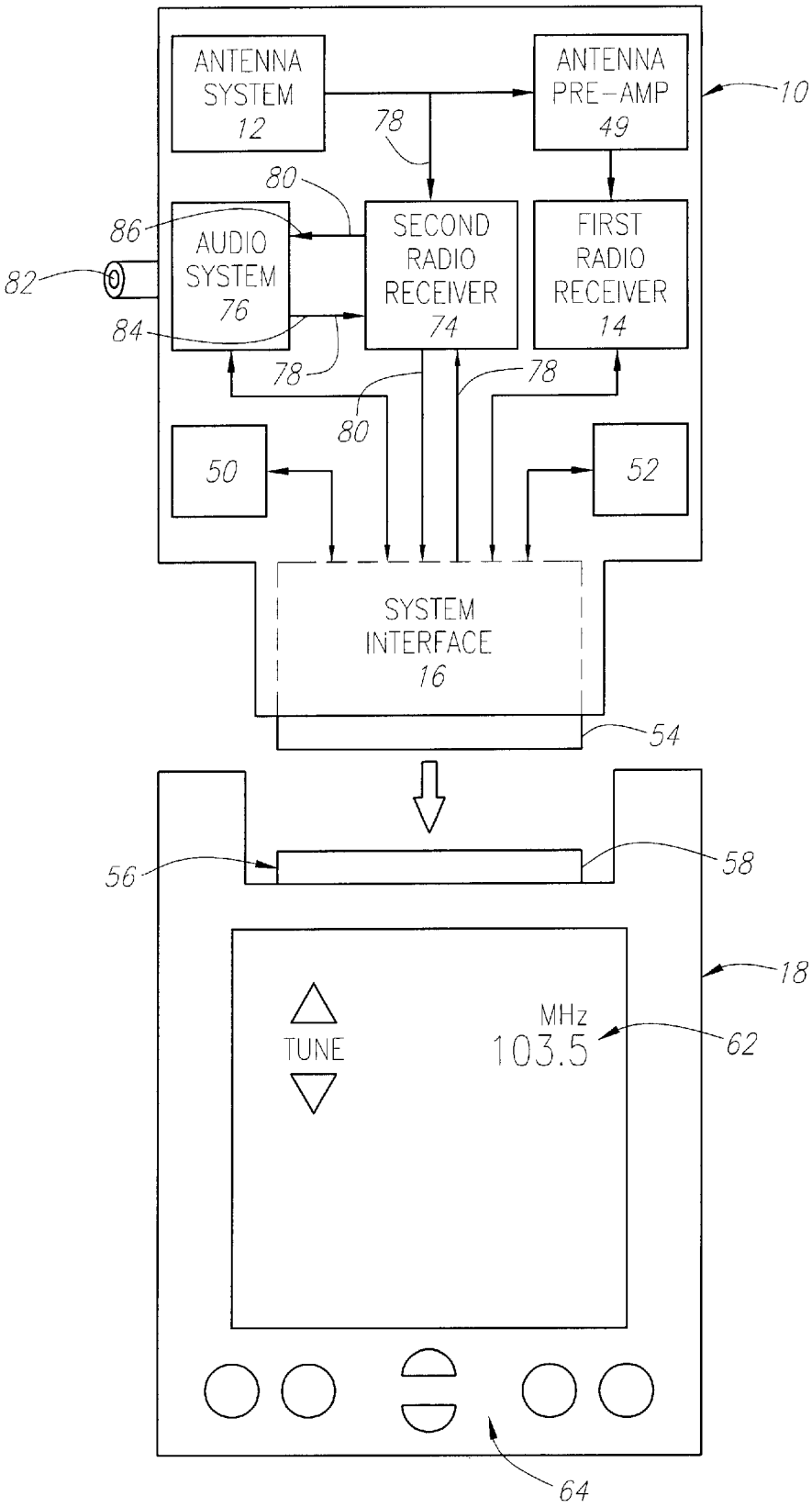
FIG. 5 is an illustration of a second preferred embodiment of a radio unit for computer systems in accordance with the present invention.

In a second embodiment, the radio unit 10 may further include a second radio receiver 74 for receiving transmitted audio information and an audio system 76, as shown in FIG. 5. The second radio receiver 74 may have at least one input 78 and at least one output 80 and, very preferably, comprises a self-tuned radio, such as Philips Semiconductors Part No. TEA5757HL. One or more of the inputs 78 of the second radio receiver 74 may be coupled with the integrated antenna system 12, and the second radio receiver 74 preferably is capable of receiving transmitted audio information (not shown) substantially via the integrated antenna system 12. At least one of inputs 78 of the second radio receiver 74 may be coupled with the integrated antenna system 12 via an antenna pre-amplifier 49. The transmitted audio information may include information such as incoming music or speech information from, for example, a commercial radio station.

At least one of the inputs 78 and at least one of the outputs 80 of the second radio receiver 74 each may be coupled with the interface system 16 and preferably are capable of communicating with the interface system 16. For example, at least one of the outputs 80 of the second radio receiver 74 may receive one or more preselected audio receiving parameters (not shown) from the receiver memory system 52 and/or the interface system 16. A controller (not shown) may be included in the interface system 16 and preferably is coupled with the second radio receiver 74, the audio system 76, and the interface system 16, and the second radio receiver 74, the audio system 76, and the interface system 16 each preferably communicate substantially via the controller. A non-volatile memory system coupled with the controller may contain default information and/or software or firmware for operating the controller and/or the radio unit 10.

Further, at least one of the inputs 78 and/or at least one of the outputs 80 of the second radio receiver 74 may be coupled with, and capable of communicating with, at least one of the outputs 84 and/or at least one of the inputs 86, respectively, of the audio system 76. The audio system 76 may selectively audibly present the transmitted audio information and preferably comprises at least one audio jack 82 and/or at least one speaker (not shown). The second radio receiver 74 very preferably, is coupled with the audio system 76 substantially via an amplifier (not shown). The amplifier may comprise any form of amplifier, including a monophonic amplifier or a stereo amplifier.

The second radio receiver 74 may be capable of operating in accordance with the preselected audio receiving parameters. The preselected audio receiving parameters may be retained in a receiver memory system 52 and may include, for example, one or more preselected center frequencies. The receiver memory system 52 may be included within, and/or coupled with, the first radio receiver 14, the second radio receiver 74, and/or the interface system 16, and may comprise any form of electronic and/or magnetic storage medium, such as, for example, SRAM, DRAM, EEPROM, FLASH, a hard drive, or any other form of storage medium. The receiver memory system 52 preferably comprises non-volatile memory. Very preferably, the preselected data receiving parameters and/or the preselected audio receiving parameters are respectively stored within the first radio receiver 14 and/or the second radio receiver 74.

In operation, a radio unit 10 with a first radio receiver 14 and a second radio receiver 74 may be removably connected to a computer system 18 substantially via an interface system 16. The second radio receiver 74 may function in accordance with one or more preselected audio receiving parameters (not shown), such as a first predetermined audio frequency. The audio receiving parameters may be retained by a receiver memory system 52 (not shown). The receiver memory system 52 may be coupled with, and capable of communicating with, the first radio receiver 14, the second radio receiver 74, and/or the interface system 16. Very preferably, the receiver memory system 52 also includes a catalog of one or more preselected audio frequencies, each of which may be selectively communicated to the second radio receiver 74. A preselected audio frequency may be selected automatically based upon a preselected criteria and/or manually, for example, via the computer system 18 and/or an input device (not shown) provided on the radio unit 10. Further, the computer system 18 and/or the input device on the radio unit 10 may be utilized to add and/or may delete one or more preselected audio frequencies from the receiver memory system 52.

During and/or after identification and/or configuration, the second radio receiver 74 may communicate one or more of the preselected audio receiving parameters to the computer system 18 substantially via the interface system 16. One or more of the preselected audio receiving parameters then may be presented by the computer system 18; for example, the preselected audio receiving parameters may be visually presented on a display 62 coupled with the computer system 18. Through use of an input device 64, such as buttons or a stylus, coupled with the computer system 18, one or more of the preselected audio receiving parameters may be adjusted to comprise revised audio receiving parameters, such as a second predetermined audio frequency. The computer system 18 preferably communicates the revised audio receiving parameters to the second radio receiver 74 substantially via the interface system 16. The second radio receiver 74 then may implement, and/or retain within the receiver memory system 52, the audio receiving parameters.

In addition, the second radio receiver 74 may receive transmitted audio information substantially via the integrated antenna system 12 in accordance with the preselected audio receiving parameters and/or the revised audio receiving parameters. The second radio receiver 74 preferably communicates the transmitted audio information to an audio system 76, which preferably selectively audibly presents the transmitted audio information. The transmitted audio information may be audibly presented by any type of audio system 76, including, for example, at least one speaker and/or at least one audio jack into which one or more audio accessories, such as headphones and/or external amplified speakers, may be connected. Very preferably, the transmitted audio information, which may comprise one or more audio channels, is amplified while being communicated from the second radio receiver 74 to the audio system 76.

To conserve power, components of the radio unit 10, such as, for example, the first radio receiver 14, the second radio receiver 74, and/or the audio system 76, of the radio unit 10 each preferably are capable of being independently and/or automatically powered down. Each component may be automatically powered down when a preselected criteria, such as non-use for a predetermined period of time, has been satisfied. The radio unit 10 also may include a capability for manually powering down each component, for example, substantially via a switch 66 provided on the radio unit 10 and/or a power down command communicated from the computer system 18 to the radio unit 10. Further, each component associated with the audio presentation of the transmitted audio information, including, for example, the second radio receiver 74 and/or the audio system 76, may be automatically powered down upon the removal of some and/or all of any audio accessories connected to the audio jacks 34.

Upon removal from the computer system 18, the components of the radio unit 10 may automatically power down or may remain powered by, for example, an auxiliary power source. The second radio receiver 74, if powered, may receive transmitted audio information in accordance with the preselected audio receiving parameters and/or the revised audio receiving parameters retained in the receiver memory system 52, and the transmitted audio information may be communicated to the audio system 76 for audible presentation.

While the invention is susceptible to various modifications and alternative forms, specific examples thereof have been shown by way of example in the drawings and are herein described in detail. It should be understood, however, that the invention is not to be limited to the particular forms or methods disclosed, but to the contrary, the invention is to cover all modifications, equivalents, and alternatives falling within the spirit and scope of the appended claims.

What is claimed is:

1. A radio unit for computer systems, comprising:

an integrated antenna system for receiving transmitted data information, said transmitted data information being transmitted within a commercial broadcast band;

a first radio receiver, said first radio receiver being coupled with said integrated antenna system, said integrated antenna system being capable of communicating said transmitted data information to said first radio receiver;

an interface system for removably connecting said radio unit with a computer system, said first radio receiver being coupled with said interface system and being capable of communicating with said interface system; and a second radio receiver for receiving transmitted audio information and an audio system for selectively audibly presenting said transmitted audio information, said second radio receiver being coupled with said integrated antenna system, said interface system, and said audio system.

2. The radio unit of claim 1, further comprising an amplifier, said second radio receiver being coupled with said audio system substantially via said amplifier.

3. The radio unit of claim 1, wherein said audio system includes at least one speaker, said at least one speaker being coupled with said second radio receiver.

4. The radio unit of claim 1, wherein said audio system includes at least one audio jack, said at least one audio jack being coupled with said second radio receiver.

5. The radio unit of claim 1, wherein said second radio receiver includes a receiver memory system for retaining said at least one receiving parameter for said second radio receiver.

6. The radio unit of claim 1, wherein said second radio receiver includes a receiver memory system for retaining a catalog having at least one preselected audio frequency, said receiver memory system being coupled with said second radio receiver and being capable of selectively communicating said at least one preselected audio frequency to said second radio receiver.

7. The radio unit of claim 6, wherein said receiver memory system is coupled with, and is capable of communicating with, said interface system, and said catalog is capable of being modified via said interface system.

8. The radio unit of claim 1, wherein said second radio receiver and said audio system each are capable of being powered down.

* * * * *